US008978775B2

(12) United States Patent
Lindsay et al.

(10) Patent No.: US 8,978,775 B2
(45) Date of Patent: Mar. 17, 2015

(54) DOWNHOLE VALVE ASSEMBLY AND METHODS OF USING THE SAME

(71) Applicant: Halliburton Energy Services, Inc., Houston, TX (US)

(72) Inventors: Sharlene Dawn Lindsay, Richmond, TX (US); Robert Gordon Howard, Duncan, OK (US); Desmond Wesley Jones, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/687,905

(22) Filed: Nov. 28, 2012

(65) Prior Publication Data

US 2014/0144642 A1 May 29, 2014

(51) Int. Cl.

| | |
|---|---|
| ***E21B 34/08*** | (2006.01) |
| ***E21B 43/26*** | (2006.01) |
| ***E21B 23/00*** | (2006.01) |
| *E21B 34/00* | (2006.01) |

(52) U.S. Cl.

CPC ..... *E21B 34/08* (2013.01); *E21B 43/26* (2013.01); *E21B 23/006* (2013.01); *E21B 2034/005* (2013.01)

USPC ..... 166/373; 166/308.1; 166/332.8; 166/332.1; 166/319; 166/240

(58) Field of Classification Search

CPC . E21B 23/006; E21B 2034/005; E21B 43/26; E21B 34/08; E32B 34/10

USPC ..... 166/332.8, 319, 330, 331, 332.1, 332.2, 166/373, 374, 322, 323, 325, 386, 320, 240, 166/339

See application file for complete search history.

(56) References Cited

U.S. PATENT DOCUMENTS

| | | | |
|---|---|---|---|
| 4,782,897 | A | 11/1988 | Zeller |
| 5,499,680 | A | 3/1996 | Walter et al. |
| 6,196,325 | B1 | 3/2001 | Connell et al. |
| 6,209,663 | B1 | 4/2001 | Hosie |
| 6,253,842 | B1 | 7/2001 | Connell et al. |
| 6,305,467 | B1 | 10/2001 | Connell et al. |
| 6,688,389 | B2 | 2/2004 | Connell et al. |

(Continued)

OTHER PUBLICATIONS

Filing receipt and specification for patent application entitled "Multi-interval wellbore treatment method," by Loyd Eddie East, et al., filed Apr. 9, 2012 as U.S. Appl. No. 13/442,411.

(Continued)

*Primary Examiner* — Jennifer H Gay
*Assistant Examiner* — George Gray

(57) ABSTRACT

A wellbore servicing system including a work string and a valve tool defining an flowbore, wherein the valve tool is transitionable from a first mode to a second mode, from the second mode to a third mode, and from the third mode to a fourth mode, wherein the valve tool transitions from the first mode to the second mode upon an application of pressure to the flowbore of at least a threshold pressure, wherein the valve tool transitions from the second mode to the third mode upon a dissipation of pressure from the flowbore to not more than the threshold pressure, and wherein, in the first mode, the valve tool allows fluid communication via the flowbore in a first direction and disallows fluid communication in a second direction. Further, in the second, and third modes, the valve tool allows fluid communication in both the first and second directions.

26 Claims, 4 Drawing Sheets

(56) References Cited

U.S. PATENT DOCUMENTS

| | | | | |
|---|---|---|---|---|
| 6,877,558 | B2 | 4/2005 | Connell et al. | |
| 6,889,771 | B1 * | 5/2005 | Leising et al. | 166/373 |
| 7,527,104 | B2 * | 5/2009 | Branch et al. | 166/331 |
| 7,648,179 | B2 | 1/2010 | Webb et al. | |
| 7,673,688 | B1 | 3/2010 | Jones et al. | |
| 7,677,302 | B2 | 3/2010 | Ehtesham et al. | |
| 7,886,842 | B2 | 2/2011 | Howard et al. | |
| 7,918,280 | B2 | 4/2011 | Mailand et al. | |
| 7,926,580 | B1 * | 4/2011 | Darnell et al. | 166/386 |
| 8,047,293 | B2 * | 11/2011 | Xu et al. | 166/332.1 |
| 8,276,676 | B2 | 10/2012 | Hriscu et al. | |
| 2011/0209881 | A1 * | 9/2011 | Hriscu et al. | 166/387 |
| 2011/0226491 | A1 | 9/2011 | Telfer | |
| 2012/0006553 | A1 * | 1/2012 | Korkmaz | 166/332.8 |

OTHER PUBLICATIONS

Foreign communication from a related counterpart application—International Search Report and Written Opinion, PCT/US2013/068450, Jul. 28, 2014, 10 pages.

* cited by examiner

DOWNHOLE VALVE ASSEMBLY AND METHODS OF USING THE SAME

CROSS-REFERENCE TO RELATED APPLICATIONS

Not applicable.

STATEMENT REGARDING FEDERALLY SPONSORED

Not applicable.

RESEARCH OR DEVELOPMENT

Not applicable.

REFERENCE TO A MICROFICHE APPENDIX

Not applicable.

BACKGROUND

Hydrocarbon-producing wells often are stimulated by hydraulic fracturing operations, during which a servicing fluid such as a fracturing fluid or a perforating fluid may be introduced into a portion of a subterranean formation penetrated by a wellbore at a hydraulic pressure sufficient to create or enhance at least one fracture therein. Such a subterranean formation stimulation treatment may increase hydrocarbon production from the well.

A work string (e.g., tool string, coiled tubing string, and/or segmented tool string) is often used to communicate fluid to and from the subterranean formation, for example, during a wellbore stimulation (e.g., a hydraulic fracturing) operation. For example, jointed tubing may be used to form at least a portion of the work string. Additionally or alternatively, coiled tubing may also be used to form at least a portion of the work string.

Sometimes, during the performance of a wellbore servicing operation, it may be desirable to fluidicly isolate two or more sections of the work string (e.g. between a coiled tubing string and a jointed tubing string), for example, so as to close off fluid communication through the work string flowbore in at least one direction. For example, closing off fluid communication through a work string flowbore may allow, as an example, for the isolation of well pressure within the work string flowbore during run-in and/or run-out of a work string (e.g., facilitating connection and/or disconnection of one or more work string sections, such as a jointed tubing section and a coiled tubing section, two or more sections of jointed tubing, or combinations thereof). As such, there is a need for apparatuses, system, and methods of selectively allowing and/or preventing fluid communication through the flowbore of a workstring during the performance of a wellbore servicing operation.

SUMMARY

Disclosed herein is a wellbore servicing system comprising a work string, and an actuatable valve tool defining an axial flowbore and incorporated within the work string, wherein the actuatable valve tool is transitionable from a first mode to a second mode, from the second mode to a third mode, and from the third mode to a fourth mode, wherein the actuatable valve tool is configured to transition from the first mode to the second mode upon an application of pressure to the axial flowbore of at least a threshold pressure, wherein the actuatable valve tool is configured to transition from the second mode to the third mode upon a dissipation of pressure from the axial flowbore to not more than the threshold pressure, wherein, in the first mode, the actuatable valve tool is configured to allow fluid communication via the axial flowbore in a first direction and to disallow fluid communication via the axial flowbore in a second direction, and wherein, in the second, and third modes, the actuatable valve tool is configured to allow fluid communication via the axial flowbore in both the first direction and the second direction.

Also disclosed herein is a wellbore servicing method comprising disposing a wellbore servicing system comprising an actuatable valve tool in a wellbore, the actuatable valve tool generally defining an axial flowbore, wherein the actuatable valve tool is configured in a first mode, wherein in the first mode, the actuatable valve tool allows downward fluid communication via the axial flowbore and disallows upward fluid communication via the axial flowbore, making a first application of fluid pressure of at least a pressure threshold to the axial flowbore, wherein the first application of fluid pressure transitions the actuatable valve tool to a second mode in which the actuatable valve tool allows both upward and downward fluid communication, allowing a first dissipation of fluid pressure applied to the axial flowbore to less than the pressure threshold, wherein allowing the first dissipation of fluid pressure transitions the actuatable valve tool to a third mode in which the actuatable valve tool allows both upward and downward fluid communication, making a second application of fluid pressure of at least the pressure threshold to the axial flowbore, wherein the second application of fluid pressure transitions the actuatable valve tool to a fourth mode in which the actuatable valve tool allows both upward and downward fluid communication, allowing a second dissipation of fluid pressure applied to the axial flowbore to less than the pressure threshold, wherein allowing the fluid pressure applied to the axial flowbore to dissipate transitions the actuatable valve tool to the first mode.

Further disclosed herein is a wellbore servicing method comprising disposing a wellbore servicing system in a wellbore, the wellbore servicing system comprising a actuatable valve tool generally defining an axial flowbore, wherein during disposing the wellbore servicing system within the wellbore, the actuatable valve tool is configured so as to allow downward fluid communication via the axial flowbore and to disallow upward fluid communication via the axial flowbore, reconfiguring the actuatable valve tool so as to allow downward and upward fluid communication via the axial flowbore, wherein reconfiguring the actuatable valve tool comprises applying a fluid pressure of at least a pressure threshold to the axial flowbore, allowing a fluid pressure applied to the axial flowbore to dissipate to less than the pressure threshold, or combinations thereof, reconfiguring the actuatable valve tool so as to allow downward fluid communication via the axial flowbore and to disallow upward fluid communication via the axial flowbore, wherein reconfiguring the actuatable valve tool comprises applying a fluid pressure of at least a pressure threshold to the axial flowbore, allowing a fluid pressure applied to the axial flowbore to dissipate to less than the pressure threshold, or combinations thereof, and repositioning the wellbore servicing system.

Further disclosed herein is an actuatable valve tool comprising a housing defining the axial flowbore, a flapper valve, wherein, when the flapper valve is in an activated state, the flapper valve is free to move between a closed position in which the flapper valve blocks the axial flowbore and an open position in which the flapper valve does not block the axial flowbore, and wherein, when the flapper valve is in an inactivated state, the flapper valve is retained in the open position, a sliding sleeve, wherein, in a first position, the sliding sleeve does not interact with the flapper valve, and wherein, in a second position and a third position, the sliding sleeve retains the flapper valve in the open position, and a transition system configured to control the longitudinal movement of the sliding sleeve, wherein the transition system comprises a j-slot, and a lug, wherein the lug is disposed within a least a portion of the j-slot.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
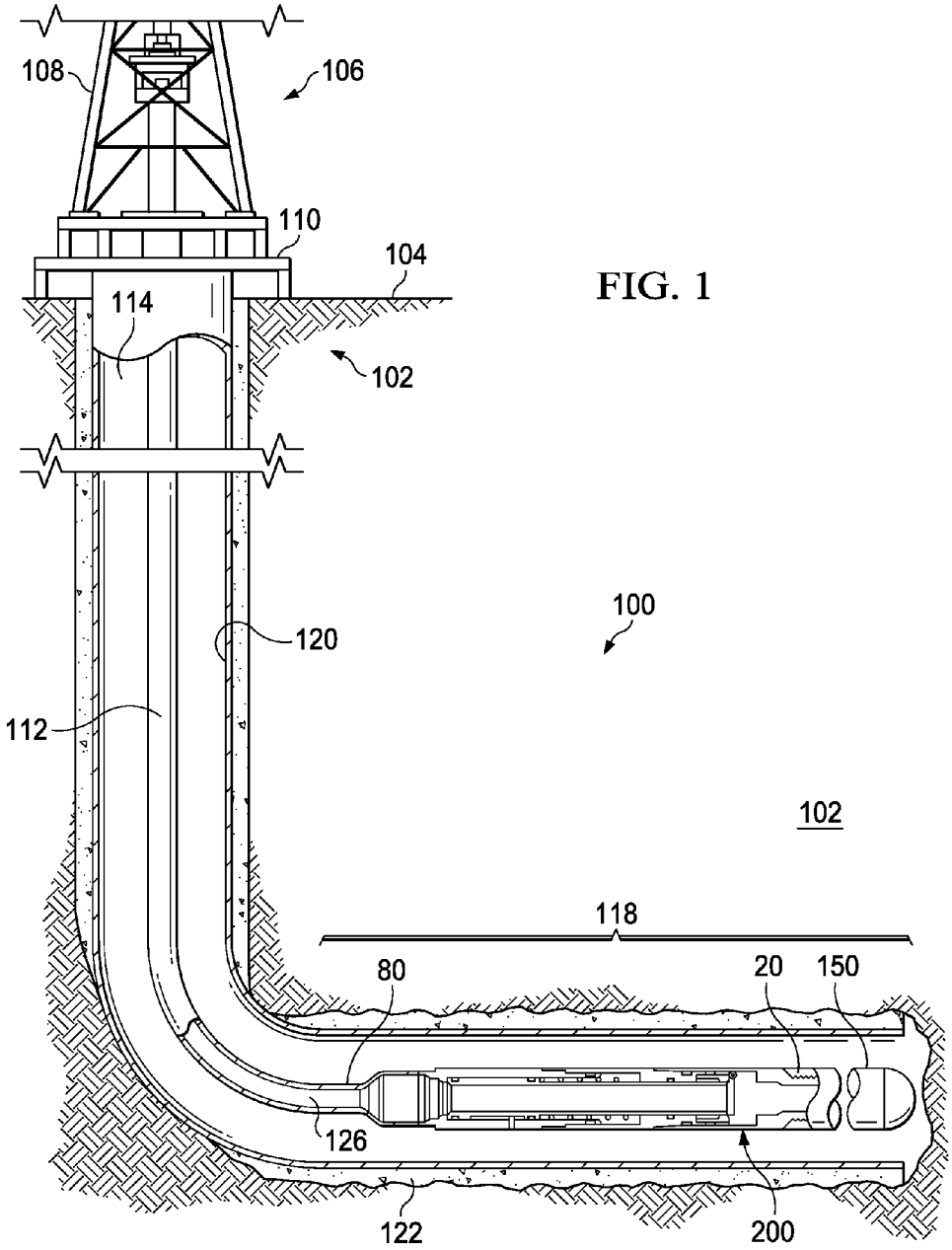
FIG. 1 is a partial cutaway view of an embodiment of an operating environment associated with an actuatable valve tool.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Disclosed herein are embodiments of wellbore servicing apparatuses, systems and methods of using the same. Particularly disclosed herein are one or more embodiments of an actuatable valve tool (AVT), systems, and methods utilizing the same. In one or more of the embodiments as will be disclosed herein, the AVT may be generally configured to transition through one or more configurations and/or phases so as to selectively allow and/or disallow fluid communication through a tubular string (e.g., a work string) in one or both directions, for example, during the performance of a wellbore servicing operation (e.g., a subterranean formation stimulation operation).

Referring to FIG. 1, an embodiment of an operating environment in which such an AVT and/or a wellbore servicing system comprising such an AVT may be employed is illustrated. As depicted in FIG. 1, the operating environment generally comprises a wellbore 114 that penetrates a subterranean formation 102 for the purpose of recovering hydrocarbons, storing hydrocarbons, disposing of carbon dioxide, or the like. The wellbore 114 may be drilled into the subterranean formation 102 using any suitable drilling technique. In an embodiment, a drilling or servicing rig 106 disposed at the surface 104 comprises a derrick 108 with a rig floor 110 through which a work string (e.g., a drill string, a tool string, a segmented tubing string, a jointed tubing string, or any other suitable conveyance, or combinations thereof) generally defining an axial flow bore 126 may be positioned within or partially within wellbore 114. In an embodiment, such a work string may comprise two or more concentrically positioned strings of pipe or tubing (e.g., a first work string may be positioned within a second work string). The drilling or servicing rig may be conventional and may comprise a motor driven winch and other associated equipment for lowering the work string into wellbore 114. Alternatively, a mobile workover rig, a wellbore servicing unit (e.g., coiled tubing units), or the like may be used to lower the work string into the wellbore 114. In such an embodiment, the work string may be utilized in drilling, stimulating, completing, or otherwise servicing the wellbore, or combinations thereof.

The wellbore 114 may extend substantially vertically away from the earth's surface over a vertical wellbore portion, or may deviate at any angle from the earth's surface 104 over a deviated or horizontal wellbore portion 118. In alternative operating environments, portions or substantially all of wellbore 114 may be vertical, deviated, horizontal, and/or curved and such wellbore may be cased, uncased, or combinations thereof. In some instances, at least a portion of the wellbore 114 may be lined with a casing 120 that is secured into position against the formation 102 in a conventional manner using cement 122. In this embodiment, the deviated wellbore portion 118 includes casing 120. However, in alternative operating environments, the wellbore 114 may be partially cased and cemented thereby resulting in a portion of the wellbore 114 being uncased. In an embodiment, a portion of wellbore 114 may remain uncemented, but may employ one or more packers (e.g., mechanical and/or swellable packers, such as Swellpackers™, commercially available from Halliburton Energy Services, Inc.) to isolate two or more adjacent portions or zones within wellbore 114. It is noted that although some of the figures may exemplify a horizontal or vertical wellbore, the principles of the apparatuses, systems, and methods disclosed may be similarly applicable to horizontal wellbore configurations, conventional vertical wellbore configurations, and combinations thereof. Therefore, the horizontal or vertical nature of any figure is not to be construed as limiting the wellbore to any particular configuration.

Referring to FIG. 1, a wellbore servicing system 100 is illustrated. In the embodiment of FIG. 1, the wellbore servicing system 100 comprises an AVT 200 incorporated within a work string 112 and positioned within the wellbore 114. Additionally, in an embodiment the wellbore servicing system 100 may further comprise a wellbore servicing tool 150. In such an embodiment, the wellbore servicing tool 150 may be incorporated within the work string 112, for example, at a position relatively downhole from the AVT 200. Also, in such an embodiment, the work string 112 may be positioned within the wellbore 114 such that the wellbore servicing tool 150 is positioned proximate and/or substantially adjacent to one or more zones of the subterranean formation 102.

The wellbore servicing tool 150 may be generally configured to deliver a wellbore servicing fluid to the wellbore 114, the subterranean formation 102 and/or one or more zones thereof, for example, for the performance of one or more servicing operations. For example, the wellbore servicing tool 150 may generally comprise a stimulation tool (such as a fracturing, perforating tool, and/or acidizing tool), a drilling tool (such as a drill bit), a wellbore cleanout tool, or combinations thereof. While this disclosure may refer to a wellbore servicing tool 150 configured for a stimulation operation (e.g., a perforating and/or fracturing tool), as disclosed herein, a wellbore servicing tool incorporated with the wellbore servicing system may be configured for various additional or alternative operations and, as such, this disclosure should not be construed as limited to utilization in any particular wellbore servicing context unless so-designated. In an embodiment, the wellbore servicing tool 150 may be selectively actuatable, for example, being configured to provide or not provide a route of fluid communication from the wellbore servicing tool 150 to the wellbore 114, the subterranean formation 102, and/or a zone thereof. In such an embodiment, the wellbore servicing tool 150 may be configured for actuation via the application of fluid pressure to the wellbore servicing tool 150, via the operation of a ball or dart, via the operation of a shifting tool (e.g., a wireline tool), or combinations thereof, as will be appreciated by one of skill in the art upon viewing this application. Although the embodiment of FIG. 1 illustrates a single wellbore servicing tool 150 (e.g., being positioned substantially proximate or adjacent to a formation), one of skill in the art viewing this disclosure will appreciate that any suitable number of wellbore servicing tools may be similarly incorporated within a work string 112, for example, 2, 3, 4, 5, 6, 7, 8, 9, 10, etc. wellbore servicing tools.

In the embodiment of FIG. 1, the work string 112 comprises at least one segment of jointed tubing 20 (e.g., a "joint"). For example, in the embodiment of FIG. 1, the jointed tubing 20 may be coupled to the AVT 200 and may comprise a portion of the work string 112 relatively downhole from the AVT 200. Not intending to be bound by theory, the jointed tubing 20 may provide a relatively strong, reliable work string flowbore 126 at the location of the stimulation operation. For example, the wellbore servicing tool 150 may be incorporated within the jointed tubing 20 portion of the work string 112. Additionally, in an embodiment, the wellbore servicing system 100 may further comprise at least one segment of coiled tubing 80. For example, in the embodiment of FIG. 1, the coiled tubing 80 may be coupled to the AVT 200 and may comprise a portion of the work string 112 relatively uphole from the valve tool 200. Not intending to be bound by theory, the coiled tubing 80 may allow for the work string 112 to be quickly and easily moved uphole or downhole within the wellbore 114 (e.g., to be quickly and easily "run-in" or "run-out" of the wellbore 114). While in the embodiment of FIG. 1, jointed tubing 20 is coupled to and located downhole from the AVT 200 and coiled tubing 80 is coupled to and located uphole from the valve tool 200, in other embodiments, various suitable additional or alternative configurations may be similarly employed. For example, in alternative embodiments, jointed tubing 20 may be located uphole from the AVT 200 and/or coiled tubing 80 may be located downhole from the valve tool 200. Furthermore, in yet another embodiment, the jointed tubing 20 or coiled tubing 80 may be located both uphole and downhole from the AVT 200 (e.g., comprising substantially all of the work string 112).

Additionally, although the embodiment of FIG. 1 illustrates a wellbore servicing system 100 comprising the AVT 200 incorporated within a work string 112, a similar wellbore servicing system may be similarly incorporated within any other suitable type of string (e.g., a drill string, a tool string, a segmented tubing string, a jointed tubing string, a casing string, a coiled-tubing string, or any other suitable conveyance, or combinations thereof), working environment, or configuration, as may be appropriate for a given servicing operation. Also, although the embodiment of FIG. 1 illustrates a single AVT 200, one of skill in the art viewing this disclosure will appreciate that any suitable number of AVTs, as will be disclosed herein, may be similarly incorporated within a work string 112, for example, 2, 3, 4, 5, etc. AVTs.

In one or more of the embodiments disclosed herein, one or more AVTs 200 may be configured to be activated while disposed within a wellbore like wellbore 114. In an embodiment, a valve tool 200 may be transitionable from a "first" mode or configuration to a "second" mode or configuration, from the "second" mode or configuration to a "third" mode or configuration, and from the "third" mode or configuration to a "fourth" mode or configuration. Further, in an embodiment, the AVT 200 may be configured so as to be transitionable from the "fourth mode or configuration back to the "first" mode or configuration. Further still, in an embodiment, the AVT 200 may be transitionable through such a sequence (e.g., first, second, third, then fourth mode) an unlimited number of iterations/cycles, as will be disclosed herein.

Figure 2A:
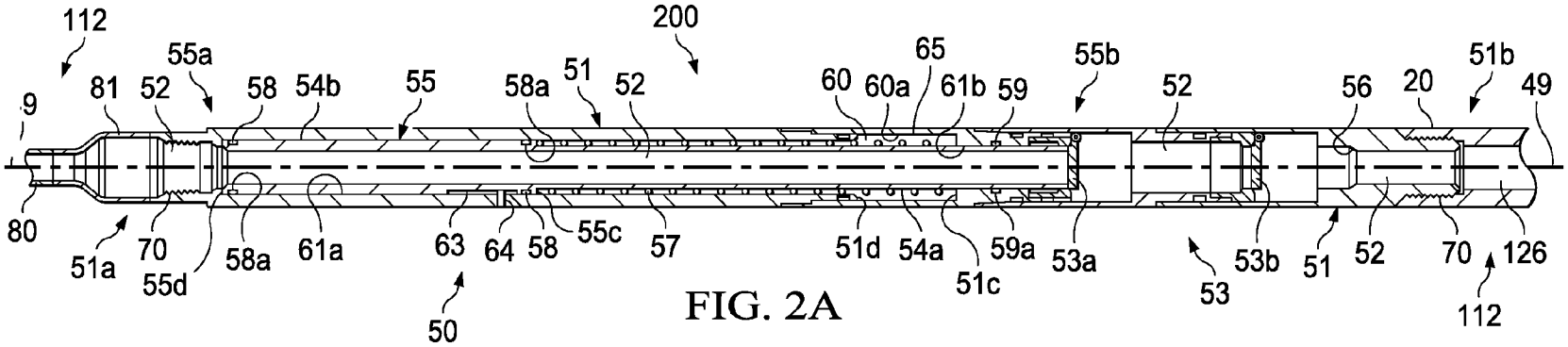
FIG. 2A is a cutaway view an embodiment of an actuatable valve tool in a first mode or configuration.

Referring to FIG. 2A, an embodiment of an AVT 200 is illustrated in the first mode or configuration. In an embodiment, when the AVT 200 is in the first mode, also referred to as a run-in or installation mode, the AVT 200 may be configured so as to allow for fluid communication therethrough in a first direction (e.g., downward fluid communication) and to not allow fluid communication therethrough in a second direction (e.g., upward fluid communication), as will be described herein. In an embodiment, as will be disclosed herein, the AVT 200 may be configured to transition from the first mode to the second mode upon the application of a pressure of at least a threshold pressure to the AVT 200. For example, the AVT 200 may be configured to transition from the first mode to the second mode upon experiencing a threshold pressure. In such an embodiment, the threshold pressure may be at least about 500 psi, alternatively, about 750 psi, alternatively, about 1,000 psi, alternatively, about 1,500 psi, alternatively, about 2,000 psi, alternatively, about 2,500 psi, alternatively, about 3,000 psi, alternatively, about 4,000 psi, alternatively, about 5,000 psi, alternatively, about 6,000 psi, alternatively, about 7,000 psi, alternatively, about 8,000 psi, alternatively, about 10,000 psi, alternatively, alternatively, about 12,000 psi, alternatively, about 14,000 psi, alternatively, about 16,000 psi, alternatively, about 18,000 psi, alternatively, about 20,000 psi, alternatively, any suitable pressure. As will be appreciated by one of skill in the art upon viewing this disclosure, the threshold pressure may depend upon various factors, for example, including, but not limited to, the type of wellbore servicing operation being implemented. In an additional or alternative embodiment, the AVT 200 may be configured to transition from the first mode to the second mode upon a fluid being communicated through the AVT 200 in a suitable direction and/or at a suitable rate. For example, the AVT 200 may be configured to transition from the first mode to the second mode upon the communication therethrough of a fluid, in a given direction, at a rate of at least a threshold fluid flow. In such an embodiment, the threshold fluid flow rate may be at least about 2 barrels per minute (BPM), alternatively, about 5 BPM, alternatively, about 10 BPM, alternatively, about 15 BPM, alternatively, about 20 BPM, alternatively, about 25 BPM, alternatively, about 30 BPM, alternatively, about 45 BPM, alternatively, about 60 BPM, alternatively, about 75 BPM, alternatively, about 90 BPM, alternatively, about 105 BPM, alternatively, about 120 BPM, alternatively, about 135 BPM, alternatively about 150 BPM, alternatively, any suitable flow rate. As will be appreciated by one of skill in the art upon viewing this disclosure the threshold flow rate may depend upon various factors including, but not limited to, the type of wellbore servicing operation being implemented.

Figure 2B:
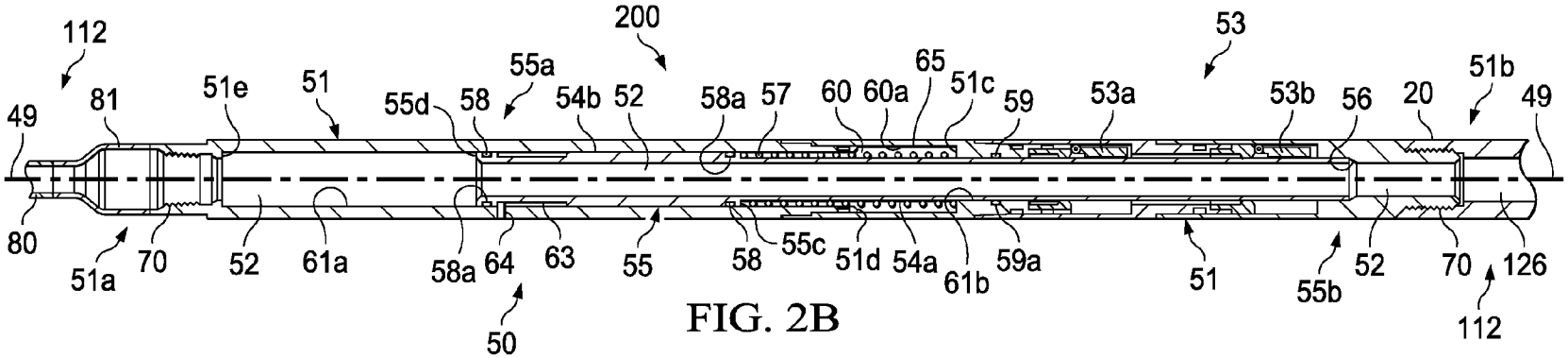
FIG. 2B is a cutaway view an embodiment of an actuatable valve tool in a second mode or configuration.

Referring to FIG. 2B, an embodiment of the AVT 200 is illustrated in the second mode or configuration. In an embodiment, when the AVT 200 is in the second mode, also referred to as the fully stroked mode, the AVT 200 may be configured so as to allow for fluid communication therethrough in the first direction (e.g., downward fluid communication), as will be described herein. In an embodiment, the AVT 200 may be configured so as to remain in the second mode for so long as a suitable pressure (e.g., a pressure of at least the threshold pressure) is applied to the AVT 200 and/or for so long as a suitable flow rate is maintained (e.g., a fluid flow rate of at least the threshold flow rate) through the AVT 200. In an embodiment, as will also be disclosed herein, the AVT 200 may be configured to transition from the second mode to the third mode upon the dissipation of the pressure applied thereto to less than threshold pressure and/or upon the cessation of fluid communication therethrough at a rate of at least the threshold flow rate. For example, the AVT 200 may be configured to transition from the second mode to the third mode by reducing the pressure applied to the AVT 200 (e.g., to less than the threshold pressure) and/or by reducing the fluid flow rate through the AVT 200 (e.g., to a rate less than the threshold flow rate).

Figure 2C:
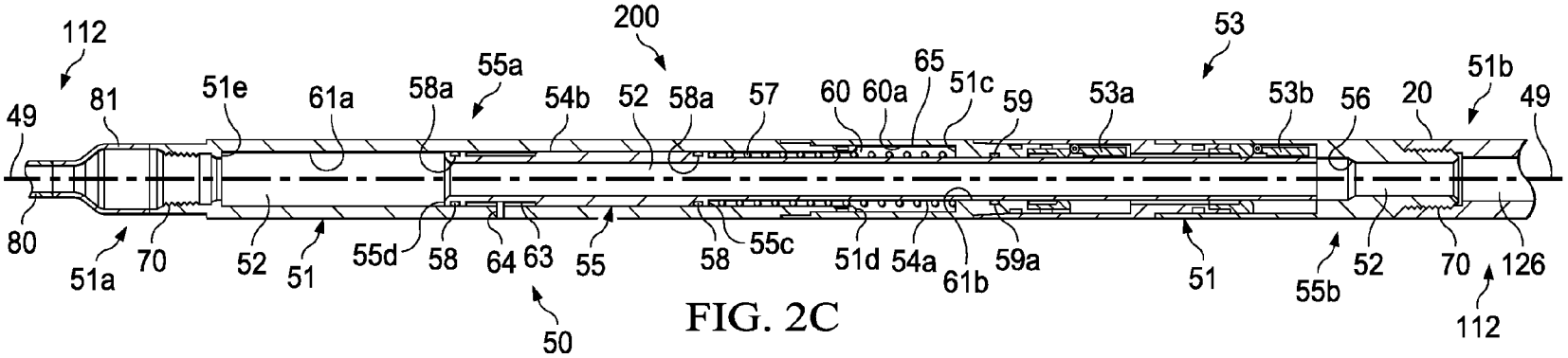
FIG. 2C is a cutaway view an embodiment of an actuatable valve tool in a third mode or configuration.

Referring to FIG. 2C, an embodiment of the AVT 200 is illustrated in third mode or configuration. In an embodiment, when the AVT 200 is in the third mode, also referred to as the reverse circulation mode, the AVT 200 may be configured so as to allow for fluid communication therethrough in both the first direction (e.g., downward fluid communication) and in the second direction (e.g., upward fluid communication), as will be described herein. In an embodiment, the AVT 200 may be configured to remain in the third mode for so long as the pressure applied thereto is less than threshold pressure and/or for so long as the flow rate of fluid communication therethrough is less than the threshold flow rate. In an embodiment as will also be disclosed herein, the AVT 200 may be configured to transition from the third position to the fourth position upon the application of a pressure of at least the threshold pressure to the AVT 200 and/or upon a fluid being communicated through the AVT 200 in a given direction at a rate of at least the threshold fluid flow, for example, as similarly disclosed herein with reference to transitioning the AVT 200 from the first mode to the second mode.

Figure 2D:
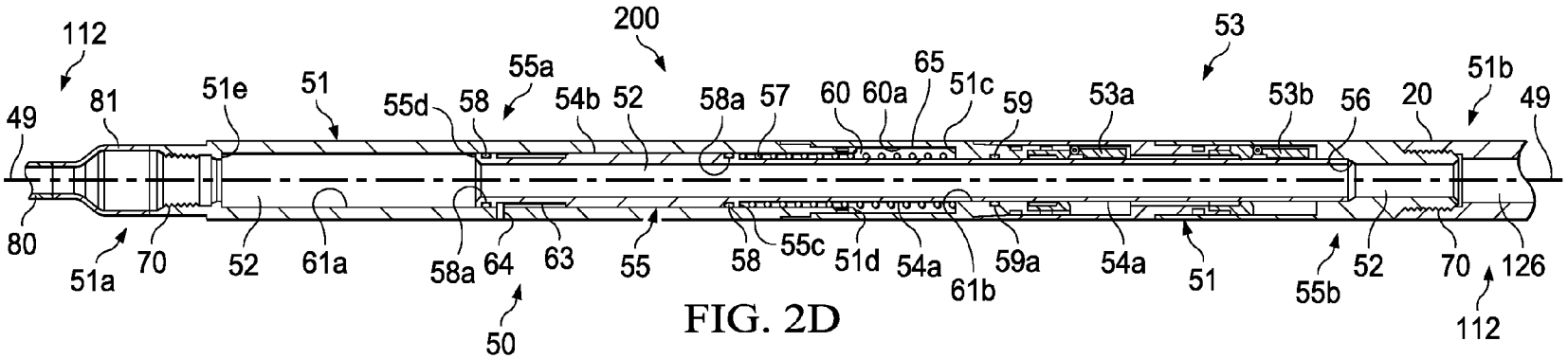
FIG. 2D is a cutaway view an embodiment of an actuatable valve tool in a fourth mode or configuration.

Referring to FIG. 2D, an embodiment of the AVT 200 is illustrated in the fourth mode or configuration. In an embodiment, the AVT 200 may be configured so as to allow for fluid communication therethrough in the first direction (e.g., downward fluid communication), as will be described herein. In an embodiment, the AVT 200 may be configured to remain in the fourth mode for so long as a suitable pressure (e.g., a pressure of at least the threshold pressure) is applied to the AVT 200 and/or for so long as a suitable flow rate is maintained (e.g., a fluid flow rate of at least the threshold flow rate) through the AVT 200. Additionally, in an embodiment, as will be disclosed herein, the AVT 200 may be configured to transition from the fourth mode back to the first mode upon the dissipation of the pressure applied thereto to less than threshold pressure and/or upon the cessation of fluid communication therethrough at a rate of at least the threshold flow rate, for example, as disclosed herein with reference to transitioning the AVT from the second mode to the third mode.

Once the AVT 200 has been returned to the first mode, in an embodiment, as will be disclosed herein, the AVT 200 may be configured so as to again be transitioned (cycled) from the first mode to the fourth mode as disclosed herein.

Referring to FIGS. 2A-2D, in an embodiment the AVT 200 generally comprises a housing 51, a sleeve 55, one or more valves (e.g., a first and second valves, 53*a* and 53*b*, respectively; cumulatively and non-specifically, valves 53), a biasing member 57, and a transition system 50. The AVT 200 may be characterized as having a longitudinal axis 49. Additionally, the AVT 200 may also be characterized as a continuation of the flowbore 126.

While an embodiment of the AVT 200 is disclosed with respect to FIGS. 2A-2D and 3, one of skill in the art upon viewing this disclosure, will recognize suitable alternative configurations. As such, while embodiments of an AVT may be disclosed with reference to a given configuration (e.g., AVT 200 as will be disclosed with respect to FIGS. 2A-2D and 3), this disclosure should not be construed as limited to such embodiments.

In an embodiment, the housing 51 may be characterized as a generally tubular body having a first terminal end 51*a* (e.g., an uphole end) and a second terminal end 51*b* (e.g., a downhole end). The housing 51 may also be characterized as generally defining a longitudinal, axial flowbore 52. In an embodiment, the housing 51 may be configured for connection to and/or incorporation within a string, such as the work string 112. For example, the housing 51 may comprise a suitable means of connection to the work string 112 (such as the jointed tubing 20 and/or the coiled tubing 80 as illustrated in FIGS. 2A-2D). For instance, in the embodiments illustrated in FIGS. 2A-2D, the first terminal end 51*a* of the housing 51 may comprise internally and/or externally threaded surfaces 70 as may be suitably employed in making a threaded connection to the work string 112 (e.g., to a coiled tubing segment, such as coiled tubing segment 80, for example, via a coiled tubing adapter 81). Also, in the embodiments illustrated in FIGS. 2A-2D, the second terminal end 51*b* of the housing 51 may also comprise internally or externally threaded surfaces 70 as may be suitably employed in making a threaded connection to the work string 112 (e.g., to a segment of jointed tubing 20). Alternatively, an AVT like AVT 200 may be incorporated within a work string like work string 112 by any suitable connection, such as, for example, via one or more quick-connector type connections. Suitable connections to a work string member will be known to those of skill in the art viewing this disclosure. In an embodiment, the AVT 200 may be integrated and/or incorporated with the work string 112 such that the axial flowbore 52 may be in fluid communication with the axial flowbore 126 defined by work string 112, for example, such that a fluid communicated via the axial flowbore 126 of the work string 112 will flow into and through the axial flowbore 52 of the AVT 200.

In an embodiment, the one or more valves 53 may be generally configured, when activated, as will be disclosed herein, to close and/or seal the longitudinal bore 52 through the AVT 200 to fluid communication therethrough in at least one direction and to allow fluid communication in the opposite direction. In an embodiment, the one or more valves 53 may be characterized as one-way or unidirectional valve, that is, configured to allow fluid communication therethrough in only a single direction (e.g., when activated). For example, in an embodiment, the one or more valves 53 may comprise flapper valves. In such an embodiment, each of the activatable flapper valves may comprise a flap or disk movably (e.g., rotatably) secured within the housing 51 (e.g., directly or indirectly) via a hinge. For example, the flapper may be hinged to the housing 51, alternatively, to a body which may be disposed within the housing 51. In an embodiment, the flapper may be rotatable about the hinge from a first, closed position in which the flapper extends into the longitudinal bore 52 to a second, open position in which the flapper does not extend into the longitudinal bore 52. In an embodiment, the flapper may be biased, for example, biased toward the first, closed position via the operation of any suitable biasing means or member, such as a spring-loaded hinge. In an embodiment, when the flapper is in the second position, the flapper may be retained within a recess within the longitudinal bore of the housing 51, such as a depression (alternatively, a groove, cut-out, chamber, hollow, or the like). Also, when the flapper is in the first position, the flapper may protrude into the longitudinal bore 52, for example, so as to sealingly engage or rest against a portion of the housing 51 (alternatively, so as to engage a shoulder, a mating seat, the like, or combinations thereof). The flapper may be round, elliptical, or any other suitable shape.

In an embodiment, as will be disclosed herein, the one or more valves 53 may be activated and/or inactivated through an interaction with the movement of the sleeve 55. As used herein, reference to the one or more valves 53 as being in an "activated" state may mean that the one or more valves 53 are free to move between the first, closed position and the second, open position. Also, as used herein, reference to the one or more valves 53 as being in an "inactivated" state may mean that the one or more valves 53 are not free to move between the first, closed position and the second, open position. For example, in an embodiment as will be disclosed herein, While the embodiments of FIGS. 2A-2D illustrate an AVT 200 comprising two valves, in alternative embodiments, an AVT may similarly comprise only a single valve, alternatively, three valves, alternatively, four valves, alternatively, any suitable number of valves. In an embodiment, the one or more valves, particularly, a first valve 53*a* and a second valve 53*b*, each comprise flapper valves.

In an embodiment, the sleeve 55 generally comprises a cylindrical or tubular structure. In an embodiment, for example, in the embodiment of FIGS. 2A-2D, the sleeve may be slidably located/positioned within the housing 51. For example, the sleeve 55 may be slidably movable between various longitudinal positions with reference to the housing 51. For example, in the embodiments shown in FIGS. 2A-2D, the sleeve 55 that is slidably disposed within the housing 51 and movable between a first (e.g., upper) position, a second (e.g., lower) position, and third (e.g., intermediate) position. For example, the sleeve 55 is shown in its first position in FIG. 2A; in its second position in FIGS. 2B and 2D; and in its third position in FIG. 2C. For example, when the sleeve 55 is in the first position, the AVT 200 may be configured in the first mode; when the sleeve 55 is in the second position (after having most-recently departed the first position), the AVT 200 may be configured in the second mode; when the sleeve 55 is in the third position, the AVT 200 may be configured in the third mode; and when the sleeve 55 is in the second position (after having most-recently departed the third position), the AVT may be configured in the fourth mode. In an embodiment, as will be disclosed herein, AVT 200 may be configured such that the sleeve 55 may be movable from the first position to the second; thereafter, from the second position to the third position; thereafter, from the third position to the second position (e.g., a second time); and, thereafter, from the second position to the first position.

In an embodiment, the relative longitudinal position of the sleeve 55 may determine if the one or more valves are in an activated state or an inactivated state. For example, when the sleeve 55 is located in the first position, the one or more valves may be in the activated state; alternatively, when the sleeve is located in the second and third positions, the one or more valves may be in the inactivated state. For example, as shown in FIG. 2A, when the sleeve is in the first position (e.g., when the AVT 200 is in the first mode), the sleeve 55 does not interfere with the movement of the one or more valves 53 and, as such, allows the biased flappers of the one or more valves 53 to move into the first, closed position and the second, open position. Alternatively, as shown in FIGS. 2B, 2C, and 2D, when the sleeve is in the second and third positions (e.g., when the AVT 200 is in the second, third, and fourth modes), the sleeve 55 will retain the flappers of the one or more valves 53 in the second, open position. The housing may comprise sufficient space, longitudinally, to allow for the sleeve 55 to move between the first, second, and third positions.

In an embodiment, the sleeve 55 may be longitudinally biased. For example, the sleeve 55 may be generally upwardly biased, for example, such that the sleeve 55 will experience a force sufficient to move the sleeve 55 in the upward direction (e.g., toward the first terminal end 51*a*) if otherwise uninhibited from such movement. For example, the sleeve 55 may be upwardly, longitudinally biased by the biasing member 57.

In an embodiment, the biasing member 57 generally comprises a suitable structure or combination of structures configured to apply a directional force and/or pressure to sleeve 55 with respect to the housing 51. Examples of suitable biasing members include a spring, a compressible fluid or gas contained within a suitable chamber, an elastomeric composition, a hydraulic piston, or the like. For example, in the embodiment of FIGS. 2A-2D, the biasing member 57 comprises a spring (e.g., a coiled, compression spring).

The biasing member 57 may be configured to apply an axial force to sleeve 55 with respect to the housing 51. For example, in the embodiment of FIGS. 2A-2D, the biasing member 57 is configured to apply an upward force to the sleeve 55 relative to the housing 51, via an upper shoulder 55*c* of the sleeve 55 throughout at least a portion of the length of the movement of the sleeve 55. Engagement between the biasing member 57 and the shoulder 55*c* of the sleeve 55 biases the sleeve 55 axially upward toward the first terminal end 51*a* of the housing 51, such that, if otherwise uninhibited, the sleeve 55 will move longitudinally/axially upward.

In such an embodiment, the biasing member 57 may be generally disposed within an annular cavity 60 which may be cooperatively defined by the housing 51 and the sleeve 55. For example, in the embodiment of FIGS. 2A-2D, the annular cavity 60 is substantially defined by the upper shoulder 55*c* and a first outer cylindrical surface 54*a* of the sleeve 55, and by a first inner cylindrical surface 61*a*, a lower shoulder 51*c*, an intermediate shoulder 51*d*, and a recessed bore surface 60*a* within the housing 51.

In an embodiment, sleeve 55 may be configured so as to be selectively moved downwardly, for example, against the biasing force applied by the biasing member 57. For example, in an embodiment, the sleeve 55 may be configured such that the application of a fluid and/or hydraulic pressure (e.g., a hydraulic pressure exceeding a threshold pressure) to the axial flowbore 52 thereof will cause sleeve 55 to move in the downward direction (e.g., toward the second terminal end 51*b*). For example, in such an embodiment, sleeve 55 may be configured such that the application of fluid pressure of at least the threshold pressure to axial flowbore 52 (e.g., via, the flowbore 126) results in a net hydraulic force applied to sleeve 55 in the axially downward direction (e.g., in the direction towards the second terminal end 51*b*). In such an embodiment, the force applied to sleeve 55 as a result of the application of such a fluid/hydraulic pressure to the AVT 200 may be greater in the axial direction toward the second terminal end 51*b* (e.g., downward forces) than the sum of any forces applied in the opposite axial direction, for example, in the axial direction toward the first terminal end 51*a* (e.g., upward forces).

For example, in an embodiment, the sleeve 55 may be configured so as to have a differential in the surface area of the downward-facing and upward-facing surfaces of the sleeve 55 which are exposed to the axial flowbore 52, for example, so as to result in a differential between the axially upward and axially downward forces upon the application of fluid/hydraulic pressure to the axial flowbore. For example, in an embodiment, one or more of the interfaces between the housing 51 and the sleeve 55 may be sealed, for example, so as to provide such a differential in the surface area of the downward-facing and upward-facing surfaces of the sleeve 55 which are exposed to the axial flowbore 52. In the embodiment of FIGS. 2A-2D, the annular cavity 60 is sealed from the axial flowbore 52 by one or more upper seals 58 (each disposed in an upper seal groove 58*a* within the sleeve 55) and a lower seal 59 (disposed in a lower seal groove 59*a* within the housing 51) located at the interfaces between the sleeve 55 and the housing 51. Particularly, in the embodiment of FIGS. 2A-2D, the upper seal 58 is located at the interface between the second outer cylindrical surface 54*b* of the sleeve 55 and the first inner cylindrical surface 61*a* of the housing 51. Also, in the embodiment of FIGS. 2A-2D, the lower seal 59 is located at the interface between first outer cylindrical surface 54*a* of the sleeve 55 and the second inner cylindrical surface 61*b* of the housing 51. Suitable seals include but are not limited to a T-seal, an O-ring, a gasket, or combinations thereof. In an additional embodiment metal, graphite, rod seals, piston seals, symmetrical seals, or combinations thereof. These seals serve to isolate annular cavity 60 between the sleeve 55 and the housing 51, preventing fluid flow across the seal in order to define a pressure sealed annular space 60. For example, the upper seal 58 and the lower seal 59 isolate the upper shoulder 55*c* (e.g., a downward-facing surface, not intending to be bound by theory, which would have the effect of applying an upward force to the sleeve upon the application of a fluid/hydraulic force thereto) of the sleeve 55 from the axial flowbore 52. One of ordinary skill in the art, upon viewing this disclosure, will appreciate the various suitable, alternative configurations by which seals may seal the annular cavity 60 from the bore 52 as the sleeve 55 moves between the various positions, as disclosed herein. In an embodiment, the differential between the upward and downward forces applied to the sleeve 55, upon the application a fluid/hydraulic pressure to the axial flowbore 52 of at least the threshold pressure (e.g., resulting in a net, downward force), may be sufficient to overcome the force applied by biasing member 57 (e.g., in the upward direction).

In an additional or alternative embodiment, the sleeve 55 may be configured such that the movement of fluid through the axial flowbore 52 (e.g., downward movement of fluid exceeding a threshold flow rate) will cause sleeve 55 to move in the downward direction (e.g., toward the second terminal end 51*b*). For example, in such an embodiment, the sleeve 55 may be configured such that fluid movement through the sleeve 55 in a given direction (e.g., downwardly) will apply a force to the sleeve 55 in the direction of the movement. For example, not intending to be bound by theory, the sleeve 55 may experience a force as a result of the fluid movement therethrough resulting from the frictional interaction between the moving fluid and the sleeve 55. For example, in such an embodiment, the sleeve 55 may comprise at least one surface configured so as exhibit a relatively increased coefficient of fluid movement as to fluid moving therethrough; for example, the sleeve 55 (e.g., portions of the sleeve exposed to fluid flow) may be configured to exhibit a drag coefficient sufficient to cause the movement of fluid through the AVT 200 (e.g., through the sleeve 55) to exert a force against the sleeve 55 in generally the same direction as the fluid movement (e.g., in a downward direction). In such an embodiment, the sleeve 55 may comprise one or more features (e.g., physical features) configured to alter the drag coefficient as to a fluid moving therethrough, for example, a roughened surface, various, lips, shoulders, grooves, or other profiles, or combinations thereof. In an embodiment, the force exerted against the sleeve 55, upon the movement of a fluid therethrough at a flow rate of at least threshold flow rate (e.g., resulting in a net, downward force), may be sufficient to overcome the force applied by biasing member 57 (e.g., in the upward direction).

While one or more of the embodiments disclosed herein may refer to sleeve movement as a result of the application of a given fluid pressure and/or the communication of a fluid at a given rate, it is contemplated that a given AVT may be configured for movement via either of these, or by any other suitable method, apparatus, or system.

In an embodiment, the transition system 50 may be configured to guide the axial and/or rotational movement of the sleeve 55 relative to the housing 51. In an embodiment, the transition system 50 generally comprises a recess or slot 63 and one or more lugs 64, for example, a "J-slot," a control groove, an indexing slot, or combinations thereof. In an embodiment, through the interaction between the slot 63 and the one or more lugs 64, the transition system 50 may be configured to guide the rotational and axial movement of sleeve 55, as will be disclosed herein. In an embodiment, recess or slot 63 may be disposed on the second outer cylindrical surface 54*b* of the sleeve 55 and, the lug 64 may extend inwardly from the first inner cylindrical surface 61*a* of the housing 51 (e.g., a pin disposed within a bore within the housing 51). In an alternative embodiment, a slot like slot 63 may be similarly disposed within the housing and may interact with a lug like lug 64 extending outwardly from the sleeve. In an embodiment, the slot 63 may be characterized as a continuous slot. For example, the slot 63 may comprise a continuous J-slot. As used herein, a continuous slot refers to a slot, such as a groove or depression having a depth beneath the outer surface 54 of the sleeve 55 and extending entirely about (i.e., 360 degrees) the circumference of sleeve 55, though not necessarily in a single straight path. For example, as will be discussed herein, a continuous J-slot refers to a design configured to receive one or more protrusions or lugs (e.g. lug 64) coupled to and/or integrated within a component (e.g., housing 51), so as to guide the axial and/or rotational movement of that component through the J-slot, for example due to the physical interaction between the lug and the upper and lower shoulders of the slot.

Figure 3:
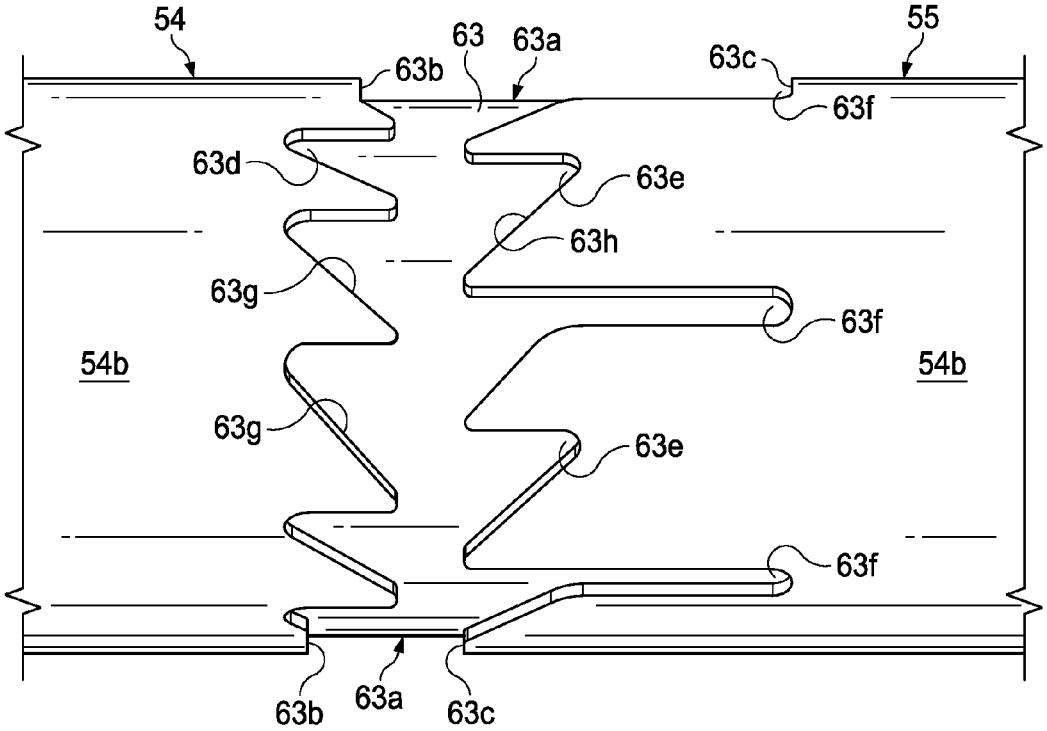
FIG. 3 is a side view of an embodiment of a sleeve having a J-slot associated therewith.

Referring to FIG. 3, an embodiment of the slot 63 (e.g., a J-slot) is illustrated disposed on the outer surface of the sleeve 55. In the embodiment of FIG. 3, the slot 63 is disposed on the second outer cylindrical surface 54*b* of the sleeve 55. The slot 63 extends beneath (e.g., a groove or slot depth) the second outer cylindrical surface 54*b*, partially through the sleeve 55 (e.g., radially inward) and is generally defined by an axially upper shoulder 63*b* (e.g., which forms the upper bound of the slot 63), an axially lower shoulder 63*c* (e.g., which forms the lower bound of the slot 63) and an inner surface 63*a* extending between upper shoulder 63*b* and lower shoulder 63*c*. Inner surface 63*a* and upper shoulder 63*b* generally define one or more upper notches 63*d* extending axially upward (i.e., to the left in the Figures) toward first sleeve terminal end 55*a*. The upper shoulder 63*b* may comprise a profile having one or more upper sloped edges 63*g* extending between each upper notch 63*d*. Also, inner surface 63*a* and lower shoulder 63*c* generally define one or more first or short lower notches 63*e* and one or more second or long lower notches 63*f* extending axially downward (i.e., to the right in the Figures) toward second sleeve terminal end 55*b*. Long lower notches 63*f* extend farther axially in the direction of second sleeve terminal end 55*b* than short lower notches 63*e*. Moving radially around the circumference of inner surface 63*a*, each long lower notch 63*f* is followed by a short lower notch 63*e*, for example, thereby forming an alternating pattern of long lower notches 63*f* and short lower notches 63*e* (e.g., long lower notch 63*f*-short lower notch 63*e*-long lower notch 63*f*-short lower notch 63*e*, etc.). The lower shoulder 63*c* may comprise a profile having one or more lower sloped edges 63*h* extending between each long lower shoulder 63*f* and short lower shoulder 63*e*, partially defining lower shoulder 63*c*. One of ordinary skill in the art, upon viewing this disclosure, would appreciate various additional and/or alternatively configurations of a slot, such as slot 63.

In an embodiment, the slot 63 and lug 64 may be configured so as to interact to guide the sleeve 55, upon the application of various forces sufficient to move the sleeve 55 longitudinally being applied thereto (e.g., alternating downward and upward forces, as disclosed herein), from the first position to second position, from the second position to the third position, from the third position again to the second position, from the second position again to the first position, and then to repeat the cycle. For example, in an embodiment, the slot 63 and lug 64 may interact such that when the sleeve 55 is in the first position, the lug 64 may be generally disposed in one of the long lower notches 63*f*. In an embodiment, the slot 63 and lug 64 may also interact such that, upon the application of a downward force to the sleeve 55 sufficient to overcome upward forces applied to the sleeve 55, the lug 64 will move through the slot 63 from the long lower notch 63*f* to one of the upper notches 63*d*, for example, causing the sleeve 55 to move radially along with the downward movement thereof and, thereby, causing the sleeve 55 to arrive in the second position. Thereafter, upon relieving the downward force applied to the sleeve 55 such that the upward forces applied to the sleeve 55 overcome the downward forces applied thereto, the lug 64 will move through the slot 63 from the upper notch 63*d* to one of the short lower notches 63*e*, for example, causing the sleeve 55 to move radially along with the upward movement thereof and, thereby, causing the sleeve 55 to arrive in the third position. Thereafter, upon another application of a downward force to the sleeve 55 sufficient to overcome upward forces applied to the sleeve 55, the lug 64 will move through the slot 63 from the short lower notch 63*e* to another of the upper notches 63*d*, for example, causing the sleeve 55 to move radially along with the downward movement thereof and, thereby, causing the sleeve 55 to return to the second position. Thereafter, upon again relieving the downward force applied to the sleeve 55 such that the upward forces applied to the sleeve 55 overcome the downward forces applied thereto, the lug 64 will move through the slot 63 from the upper notch 63*d* to another of the long lower notches 63*f*, for example, causing the sleeve 55 to move radially along with the upward movement thereof and, thereby, causing the sleeve 55 to return to the first position. It is understood that the sleeve 55 is free to rotate within the housing 51, for example, so as to allow the lug 64 to cycle (e.g., move both radially and longitudinally) with respect to the slot 63.

As such, in an embodiment, AVT 200 may be configured to transition from the first mode to the second mode, from the second mode to the third mode, from the third mode to the fourth mode, and from the fourth mode back to the first mode (e.g., by alternatingly applying pressure to the AVT 200 and allowing the pressure applied to the AVT 200 to dissipate). In an embodiment, for example, where the slot 63 is a continuous slot, the AVT 200 may be cycled, as disclosed herein, an unlimited number of cycles.

One or more of embodiments of an AVT (e.g., such as AVT 200) and/or a wellbore servicing system (e.g., such as wellbore servicing system 100) comprising such an AVT 200 having been disclosed, one or more embodiments of a wellbore servicing method employing such a wellbore servicing system 100 and/or such an AVT 200 are also disclosed herein. In an embodiment, a wellbore servicing method may generally comprise the steps of positioning a work string (e.g., such as work string 112) having an AVT 200 incorporated therein within a wellbore (such as wellbore 114), communicating a fluid through the work string 112, and repositioning the work string 112. As will be disclosed herein, the AVT 200 may control fluid movement through the work string 112 during the wellbore servicing method. For example, as will be disclosed herein, during the step of positioning the work string 112 within the wellbore 114 and/or the step of repositioning the work string 112, the AVT 200 may be configured to prohibit fluid communication out of the wellbore 114 through the work string 112 (e.g., upward fluid communication through the work string 112). Also, for example, during the step of communicating the fluid through the work string 112, the AVT 200 may be configured to allow fluid communication through the work string 112 in both directions (e.g., upward and downward fluid communication) as will disclosed herein.

In an embodiment, the wellbore servicing method may further comprise re-positioning the work string 112 and, a second time, communicating a fluid through the work string 112, as will be disclosed herein.

In an embodiment, positioning the work string 112 comprising the AVT 200 may comprise forming and/or assembling the components of the work string 112, for example, as the work string 112 is run into the wellbore 114. For example, referring to the embodiment of FIG. 1 where the work string 112 comprises a jointed tubing string 80 located downhole from the AVT 200, the jointed tubing segments may be assembled as the jointed tubing is run-in. In some embodiments as disclosed herein, a wellbore servicing tool (such as wellbore servicing tool 150) may be incorporated within the jointed tubing string, for example, downhole relative to the AVT 200. In the embodiment of FIG. 1, the AVT 200 is incorporated within the work string 112 atop the jointed tubing string 80. Referring again to the embodiment of FIG. 1, the coiled tubing may be attached atop the AVT 200, for example, via a suitable coiled tubing adaptor such as coiled tubing adapter 81. Alternatively, as disclosed herein, one or more AVTs 200 may be incorporated/integrated within the work string 112 at any suitable location.

In an embodiment, the work string 112 may be run into the wellbore 114 with the AVT 200 configured in the first mode, for example, with the sleeve 55 in the first position as disclosed herein and as illustrated in the embodiment of FIG. 2A. In such an embodiment, with the AVT 200 configured in the first mode, the AVT 200 will not allow upward fluid communication therethrough (and, as such, will not allow upward fluid communication through the work string 112) but will allow downward fluid communication therethrough (and, as such, will allow downward fluid communication through the work string 112). For example, as shown in the embodiment of FIG. 2A, when the AVT 200 is configured in the first mode (e.g., when the sleeve 55 is in the first position), the one or more flapper valve 53 may be activated, that is, free to move into the first, closed position.

In an embodiment, the work string 112 may be run into the wellbore 114 to a desired depth. For example, the work string 112 may be run in such that the wellbore servicing tool 150 is positioned proximate to one or more desired subterranean formation zones to be treated (e.g., a first formation zone).

In an embodiment, communicating a fluid through the work string 112 may comprise communicating a fluid from the surface 104 (e.g., from a wellbore servicing equipment component located at the surface 104) through the work string 112 into the formation 102 (for example, forward circulating a fluid through the work string 112 and the AVT 200). In an embodiment, the fluid may be communicated (e.g., pumped, for example, via the operation of one or more wellbore servicing equipment components, such as one or more high-pressure pumps). In an embodiment, the fluid communicated (e.g., forward-circulated) through the work string 112 (e.g., and the AVT 200) may comprise a wellbore servicing fluid. Nonlimiting examples of a suitable wellbore servicing fluid include but are not limited to a fracturing fluid (such as a proppant-laden fluid, a foamed fluid, or the like), a perforating or hydrajetting fluid, an acidizing fluid, the like, or combinations thereof. The wellbore servicing fluid may be communicated at a suitable rate and pressure for a suitable duration. For example, the wellbore servicing fluid may be communicated at a rate and/or pressure sufficient to initiate or extend a fluid pathway (e.g., a perforation or fracture) within the subterranean formation 102 and/or a zone thereof. Additionally, in an embodiment, a second fluid (e.g., a component fluid) may be communicated into the wellbore 114 via a second flow path substantially contemporaneously with the communication of fluid through the work string 112. For example, the second flow path may comprise an annular space surrounding the work string 112. The contemporaneous communication via multiple flow paths is disclosed in U.S. application Ser. No. 13/442,411 to East, et al., which is disclosed herein by reference in its entirety.

In an embodiment, communicating a fluid through the work string 112, for example, forward circulating a fluid through the work string 112, may comprise transitioning the AVT 200 from the first, run-in mode to the second, fully-stroked mode. For example, in an embodiment forward-circulating the fluid (e.g., the wellbore servicing fluid) though the work string 112 (e.g., at a pressure and/or flow rate about a predetermined threshold) may apply a downward force to the sleeve 55 sufficient to overcome the upward forces applied thereto and cause the sleeve to transition from the first position (e.g., as shown in FIG. 2A) to the second position (e.g., as shown in FIG. 2B).

For example, in an embodiment where the AVT 200 is activated by the communication of fluid therethrough (e.g., by pressure and/or flow rate), for example, in the embodiment of FIGS. 2A-2D, communicating the fluid (e.g., pumping the wellbore servicing fluid) downwardly via the flowbore 126 of the work string 112 may increase the fluid pressure within work string 112 (e.g., within flowbore 126 or the work string 112 and the axial flow bore 52 of the AVT 200) and, as such, may increase the downward force applied to the sleeve 55. For example, the AVT 200 may be configured such that the pressures attained within the axial flow bore 52 during the servicing operation (e.g., during pumping the wellbore servicing fluid) may be greater than the pressure threshold associated with AVT 200. As previously discussed, the biasing member 57 applies an upward force to sleeve 55. When the downward force applied to the sleeve 55 exceeds the force in the axially upward direction provided by biasing member 57 (and, any upward forces due to the application of fluid pressure), the sleeve 55 shifts downward, moving rotationally and axially as the lug 64 follows the profile of slot 63. The sleeve 55 may slide downward until it reaches its maximum downward position (e.g., the second position). In an embodiment, the maximum downward position may be defined by the engagement between the lug 64 and one of the upper notches 63*d* of the slot 63, as shown in FIG. 3. Specifically, as the sleeve 55 moves downward, the lug 64 may be displaced from one of the lower notches 63*f* to the upper notch 63*d*. For example, as the sleeve moves downwards, the upper shoulder 63*b* (e.g., the upper sloped edges 63*g*) may guide the lug 64 towards the upper notch 63*d*. As lugs 64 enter upper notches 63*d* and engages the upper shoulder 63*b*, the sleeve 55 comes to rest in the second position, corresponding to the second, fully-stroke mode of wellbore servicing tool 200. In an embodiment, the maximum downward position may additionally or alternatively be defined by the engagement between the sleeve 55 (e.g., the second sleeve terminal end 55*b*) and a shoulder 56 of the housing 51, as shown in FIG. 2B.

In an embodiment, the fluid communicated through the work string 112 (e.g., through the AVT 200) may be characterized abrasive, corrosive, and/or erosive (for example, containing particulate material, such as sand). For example, in an embodiment as disclosed herein, the fluid may comprise a wellbore servicing fluid, for example a fracturing fluid comprising a proppant such as sand. In an embodiment, movement of the sleeve 55 to the second position, as disclosed herein, may protect and/or substantially protect one or more components of the AVT 200 from experiencing the potentially abrasive, corrosive, and/or erosive fluids communicated therethrough. For example, in the embodiment of FIG. 2B, movement of the sleeve 55 to the second positions obscures and/or blocks the one or more valve 53, for example, such that the one or more valves 53 do not experience (e.g., are generally unexposed) to the fluid communicated through the AVT 200.

In an embodiment, when a desired amount of the servicing fluid has been communicated, for example, sufficient to create a perforation or fracture of a desired number or character, an operator may cease the communication of fluid (e.g., cease the downward communication of a wellbore servicing fluid), for example, by ceasing to pump the servicing fluid into work string 112.

In an embodiment, ceasing the communication of fluid (alternatively, decreasing the pressure at which the fluid is communicated, decreasing the rate at which the fluid is communicated, or combinations thereof) may comprise transitioning the AVT 200 from the second, fully-stroked mode to the third, reverse circulation mode. For example, in an embodiment ceasing the communication of fluid (alternatively, decreasing the pressure at which the fluid is communicated, decreasing the rate at which the fluid is communicated, or combinations thereof) may decrease the downward forces applied to the sleeve 55 such that the upward forces applied thereto (e.g., by the biasing member) overcome any such downward forces and cause the sleeve to transition from the second position (e.g., as shown in FIG. 2B) to the third position (e.g., as shown in FIG. 2C).

For example, in an embodiment where the AVT 200 is activated by the communication of fluid therethrough (e.g., by pressure and/or flow rate), for example, in the embodiment of FIGS. 2A-2D, decreasing the pressure within work string 112 (e.g., within flowbore 126 or the work string 112 and the axial flow bore 52 of the AVT 200) may decrease the downward force applied to the sleeve 55. For example, as the pressure is decreased within work string 112 (for example, to less than the pressure threshold), the upward axial force applied to sleeve 55 (e.g., applied by biasing member 57) may overcome the axially downward forces applied to sleeve 55, and produces a net force in the upward axial direction. The resulting net upward force may shift the sleeve 55 axially upward into the third configuration as the lug 64 follows the profile of the slot 63. As the sleeve moves upward, the lug 64 may be displaced from the upper notch 63*d* into one of the short lower notches 63*e*. For example, as the lugs 64 enter the short lower notches 63*e*, the sleeve 55 comes to rest in the third position, as shown in FIG. 2C. Similar to the first, run-in or installation mode, in the third, reverse-circulation mode, the sleeve may be held upward by a net force in the upward axial direction provided by the biasing member 57. As disclosed herein, in the third, reverse circulation mode, the interaction between the lug 64 and the short lower notches 63*e* cause the sleeve 55 to continue to retain the valve(s) 53*a* and 53*b* in the inactivated state (e.g., open), and further to protect and shield the valves 53 from wear/degradation associated with further fluid flow (e.g., reverse-circulation of fluid from the formation toward the surface).

Additionally or alternatively, communicating a fluid through the work string may comprise communicating a fluid through the work string 112 from the formation 102 and or the wellbore 114 through the work string 112 toward the surface 104 (for example, reverse-circulating a fluid through the work string). In an embodiment, for example, following the performance of a servicing operation with respect to a given zone of the subterranean formation, fluid (e.g., a wellbore servicing fluid, a formation fluid, such as water and/or hydrocarbons, or combinations thereof) may be reverse-circulated through the work string 112. In an embodiment, upon transitioning the AVT 200 to the third, reverse-circulation mode, a fluid may be reverse-circulated (communicated upward) through the work string 112 and/or the AVT 200. For example, when the AVT 200 is configured in the third mode, fluid may be communicated therethrough in either direction, for example, because the one or more valves 53 are retained in the inactivated (e.g., open) state, as disclosed herein.

Additionally, although the third circulation mode is called the reverse circulation mode, in an embodiment, fluid may be also communicated downward through the AVT 200 while the AVT 200 is maintained in the third mode (e.g., so long as such fluid is communicated at a pressure below the threshold fluid pressure and/or flow rate.

In an embodiment, repositioning the work string 112 may comprising positioning the work string 112 such that the wellbore servicing tool is positioned proximate to another formation zone (e.g., a second formation zone). In such embodiments, repositioning the work string may allow for such additional formation zones to be serviced. For example, the work string 112 may be run-in (e.g., deeper within the wellbore 114); alternatively, the work string 112 may be run out (e.g., shallower within the wellbore 114). In an alternative embodiment, repositioning the work string 112 may comprise removing the work string 112 from the wellbore 114.

In an embodiment, repositioning the work string 112 may comprise transitioning the AVT 200 from the third mode to the fourth mode and transitioning the AVT 200 from the fourth mode to the first mode, again.

For example, in an embodiment where the AVT 200 is activated by the communication of fluid therethrough (e.g., by pressure and/or flow rate), for example, in the embodiment of FIGS. 2A-2D, transitioning AVT 200 to the fourth, re-indexing mode, as shown in FIG. 2D, may comprise communicating (e.g., pumping) a fluid through the work string 112 via the flowbore 126 of the work string 112 so as to increase the fluid pressure within work string 112 (e.g., within flowbore 126) to the threshold pressure and/or flow rate. As previously discussed, when the downward force applied to the sleeve 55 (e.g., as a result of the application of a fluid force to the AVT 200) exceeds the force in the axially upward direction provided by biasing member 57, the sleeve 55 shifts downward, moving rotationally and axially as the lug 64 follows the profile of slot 63. The sleeve 55 may slide downward until it reaches its maximum downward position (e.g., the second position). As previously disclosed herein, in an embodiment, the maximum downward position may be defined by the engagement between the lug 64 and one of the upper notches 63*d* of the slot 63, and/or by the engagement between the sleeve 55 (e.g., second sleeve terminal end 55*b*) and a shoulder 56 of the housing 51, as shown in FIG. 2D.

In an embodiment, the AVT 200 may be maintained within the fourth, re-indexing mode for so long as the downward forces applied to sleeve 55 (e.g., as a result of the application of a fluid force to the sleeve 55) is sufficient to overcome the upward forces also applied to the sleeve 55 (e.g., by the biasing member 57). In an embodiment, a fluid may be communicated through the well string 112 (e.g., downwardly through the AVT 200) while the AVT 200 is maintained in the fourth mode. For example, in such an embodiment, a second wellbore servicing fluid (e.g., a fracturing fluid, an acidizing fluid, a clean-out fluid, the like, or combinations thereof) may be communicated downwardly through the well string 112 (e.g., downwardly through the AVT 200) while the AVT 200 is maintained in the fourth mode.

Also, in an embodiment where the AVT 200 is activated by the communication of fluid therethrough (e.g., by pressure and/or flow rate), for example, in the embodiment of FIGS. 2A-2D, transitioning AVT 200 from the fourth mode again to the first mode may comprise decreasing the downward force applied to the sleeve 55. For example, by decreasing the pressure within work string 112 (for example, to less than the pressure and/or flow rate threshold), the upward axial force applied to sleeve 55 (e.g., applied by biasing member 57) may overcome the axially downward forces applied to sleeve 55, and produce a net force in the upward axial direction. The resulting net upward force may shift the sleeve 55 axially upward into the first configuration as the lug 64 follows the profile of the slot 63. As the sleeve moves upward, the lug 64 may be displaced from the upper notch 63*d* into one of the long lower notches 63*f*. As the lugs 64 enter the long lower notches 63*f*, the sleeve 55 comes to rest in the first, run-in mode and at its upward maximum position, as shown in FIG. 2A.

In an embodiment, and as similarly disclosed herein, the work string 112 may be repositioned within the wellbore 114 with the AVT 200 or removed from the wellbore while the AVT 200 is configured in the first mode, for example, with the sleeve 55 in the first position as disclosed herein and as shown in FIG. 2A. As disclosed herein, in such an embodiment, with the AVT 200 configured in the first mode, the AVT 200 will not allow upward fluid communication therethrough (and, as such, will not allow upward fluid communication through the work string 112) but will allow downward fluid communication therethrough (and, as such, will allow downward fluid communication through the work string 112).

In an embodiment, upon repositioning the work string 112 within the wellbore 114, the process of communicating a fluid through the work string 112 (e.g., so as to perform a wellbore servicing operation with respect to various formation zones), and repositioning the work string 112 may be repeated for so many cycles as may be desired. As such, in an embodiment, the AVT 200 may be cycled (e.g., for as many cycles as may be desired) from the first mode to the second mode (e.g., to allow forward circulation, if desired), from the second mode to the third mode (e.g., to allow reverse circulation, if desired), from the third mode to the fourth mode (e.g., to again allow forward circulation, if desired), and from the fourth mode back to the first mode (e.g., to block upward fluid communication, for example, during run-in, repositioning, and/or run-out).

One of skill in the art, upon viewing this disclosure, will appreciate that an AVT (like AVT 200) may be modified (e.g., via one or modifications to the "J-slot," as disclosed herein) so as to transition between various modes (e.g., as disclosed herein) upon any suitable combination of alternatingly applying fluid force (e.g., pressure and/or flow rate above a threshold) to the AVT 200 and allowing the force applied to the AVT 200 to dissipate (e.g., decreasing the pressure and/or flow rate to less than a threshold), as disclosed herein. Similarly, an AVT may be modified so as to similarly have a fifth, sixth, seventh, eighth, ninth, or tenth mode.

In an embodiment, an AVT (like AVT 200), a system utilizing an AVT, and/or a method utilizing such an AVT and/or system a system may be advantageously employed in the performance of a wellbore servicing operation. For example, as disclosed herein, the AVT allows for an operator to selectively block fluid communication upwardly through a work string (or other tubular, wellbore string). As such, an AVT may be employed to improve safety in a wellbore/wellsite environment, for example, by providing a means of controlling the unintended escape of fluids/pressures from a wellbore (e.g., when the AVT is so-configured, as disclosed herein). Also, whereas conventional flapper-type valves are often unprotected from abrasive, corrosive, or erosive wellbore fluids during a wellbore servicing operation (e.g., during pumping a high-pressure or high flow-rate fluid), an AVT as disclosed herein will protect flapper valves therein, for example, thereby improving the reliability with which such components operate. Further still, an AVT as disclosed herein does not require that a signaling member (e.g., a ball, dart, or other tool) be run into the wellbore to transition the AVT between modes. As such, the AVT may be quickly and efficiently transitioned between various modes, as disclosed herein, via either increasing and/or decreasing the pressure applied thereto.

Additional Disclosure

The following are nonlimiting, specific embodiments in accordance with the present disclosure:

A first embodiment, which is wellbore servicing system comprising:

a work string; and an actuatable valve tool defining an axial flowbore and incorporated within the work string, wherein the actuatable valve tool is transitionable from a first mode to a second mode, from the second mode to a third mode, and from the third mode to a fourth mode, wherein the actuatable valve tool is configured to transition from the first mode to the second mode upon an application of pressure to the axial flowbore of at least a threshold pressure, wherein the actuatable valve tool is configured to transition from the second mode to the third mode upon a dissipation of pressure from the axial flowbore to not more than the threshold pressure, wherein, in the first mode, the actuatable valve tool is configured to allow fluid communication via the axial flowbore in a first direction and to disallow fluid communication via the axial flowbore in a second direction, and wherein, in the second, and third modes, the actuatable valve tool is configured to allow fluid communication via the axial flowbore in both the first direction and the second direction.

A second embodiment, which is the wellbore servicing system of the first embodiment, wherein the actuatable valve tool is transitionable from the fourth mode the first mode.

A third embodiment, which is the wellbore servicing system of the second embodiment, wherein the actuatable valve tool is configured to transition from the third mode to the fourth mode upon an application of pressure to the axial flowbore of at least a threshold pressure, and wherein the actuatable valve tool is configured to transition from the fourth mode to the first mode upon a dissipation of pressure from the axial flowbore to not more than the threshold pressure.

A fourth embodiment, which is the wellbore servicing system of one of the first through the third embodiments, wherein the actuatable valve tool comprises:

a housing defining the axial flowbore, a sliding sleeve; and a flapper valve, wherein, when the flapper valve is in an activated state, the flapper valve is free to move between a closed position in which the flapper valve blocks the axial flowbore and an open position in which the flapper valve does not block the axial flowbore, and wherein, when the flapper valve is in an inactivated state, the flapper valve is retained in the open position.

A fifth embodiment, which is the wellbore servicing system of the fourth embodiment, wherein the sliding sleeve is movable from a first longitudinal position to a second position, from the second longitudinal position to a third longitudinal position.

A sixth embodiment, which is the wellbore servicing system of the fifth embodiment, wherein, in the first position, the sliding sleeve does not interact with the flapper valve, and wherein, in the second and third positions, the sliding sleeve retains the flapper valve in the open position.

A seventh embodiment, which is the wellbore servicing system of one of fifth through the sixth embodiments, further comprising a transition system configured to control the longitudinal movement of the sliding sleeve.

An eighth embodiment, which is the wellbore servicing system of the seventh embodiment, wherein the transition system comprises:

a j-slot; and a lug, wherein the lug is disposed within a least a portion of the j-slot.

A ninth embodiment, which is the wellbore servicing system of one of the fifth through the eighth embodiments, further comprising a biasing member, wherein the biasing member is configured to bias the sliding sleeve in the second direction.

A tenth embodiment, which is the wellbore servicing system of one of the fifth through the ninth embodiments, where the sliding sleeve comprises a differential between the surfaces exposed to the axial flowbore facing the first direction and the surfaces exposed to the axial flowbore facing the second direction.

An eleventh embodiment, which is the wellbore servicing system of one of the first through the tenth embodiments, wherein the work string comprises a coiled tubing segment, a jointed tubing segment, or combinations thereof.

A twelfth embodiment, which is the wellbore servicing system of one of the first through the eleventh embodiments, wherein the wellbore servicing system further comprises a wellbore servicing tool incorporated within the work string at a location downhole from the actuatable valve tool.

A thirteenth embodiment, which is a wellbore servicing method comprising:

disposing a wellbore servicing system comprising an actuatable valve tool in a wellbore, the actuatable valve tool generally defining an axial flowbore, wherein the actuatable valve tool is configured in a first mode, wherein in the first mode, the actuatable valve tool allows downward fluid communication via the axial flowbore and disallows upward fluid communication via the axial flowbore;

making a first application of fluid pressure of at least a pressure threshold to the axial flowbore, wherein the first application of fluid pressure transitions the actuatable valve tool to a second mode in which the actuatable valve tool allows both upward and downward fluid communication;

allowing a first dissipation of fluid pressure applied to the axial flowbore to less than the pressure threshold, wherein allowing the first dissipation of fluid pressure transitions the actuatable valve tool to a third mode in which the actuatable valve tool allows both upward and downward fluid communication;

making a second application of fluid pressure of at least the pressure threshold to the axial flowbore, wherein the second application of fluid pressure transitions the actuatable valve tool to a fourth mode in which the actuatable valve tool allows both upward and downward fluid communication;

allowing a second dissipation of fluid pressure applied to the axial flowbore to less than the pressure threshold, wherein allowing the fluid pressure applied to the axial flowbore to dissipate transitions the actuatable valve tool to the first mode.

A fourteenth embodiment, which is the wellbore servicing method of the thirteenth embodiment, wherein making the first application of fluid pressure comprises downwardly communicating a fluid via the axial flowbore.

A fifteenth embodiment, which is the wellbore servicing method of one of the thirteenth through the fourteenth embodiments, wherein allowing the first dissipation of fluid pressure comprises upwardly communicating a fluid via the axial flowbore.

A sixteenth embodiment, which is the wellbore servicing method of one of the thirteenth through the fifteenth embodiments, wherein making the second application of fluid pressure comprises downwardly communicating a fluid via the axial flowbore.

A seventeenth embodiment, which is the wellbore servicing method of one of the thirteenth through the sixteenth embodiments, wherein making the second application of fluid pressure comprises upwardly communicating a fluid via the axial flowbore.

An eighteenth embodiment, which is a wellbore servicing method comprising:

disposing a wellbore servicing system in a wellbore, the wellbore servicing system comprising a actuatable valve tool generally defining an axial flowbore, wherein during disposing the wellbore servicing system within the wellbore, the actuatable valve tool is configured so as to allow downward fluid communication via the axial flowbore and to disallow upward fluid communication via the axial flowbore;

reconfiguring the actuatable valve tool so as to allow downward and upward fluid communication via the axial flowbore, wherein reconfiguring the actuatable valve tool comprises applying a fluid pressure of at least a pressure threshold to the axial flowbore, allowing a fluid pressure applied to the axial flowbore to dissipate to less than the pressure threshold, or combinations thereof;

reconfiguring the actuatable valve tool so as to allow downward fluid communication via the axial flowbore and to disallow upward fluid communication via the axial flowbore, wherein reconfiguring the actuatable valve tool comprises applying a fluid pressure of at least a pressure threshold to the axial flowbore, allowing a fluid pressure applied to the axial flowbore to dissipate to less than the pressure threshold, or combinations thereof; and repositioning the wellbore servicing system.

A nineteenth embodiment, which is the wellbore servicing method of the eighteenth embodiment, wherein reconfiguring the actuatable valve tool so as to allow downward and upward fluid communication via the axial flowbore comprises communicating a fluid downwardly via the axial flowbore.

A twentieth embodiment, which is the wellbore servicing method of the nineteenth embodiment, wherein the fluid is communicated into a subterranean formation zone at a rate and/or pressure sufficient to initiate and/or extend a perforation and/or fracture.

A twenty-first embodiment, which is the wellbore servicing method of the nineteenth embodiment, wherein the fluid is a perforating fluid, a hydrajetting fluid, a fracturing fluid, an acidizing fluid, or combinations thereof.

A twenty-second embodiment, which is the wellbore servicing method of one of the eighteenth through the twenty-first embodiments, further comprising communicating a fluid upwardly through the axial flowbore.

A twenty-third embodiment, which is the wellbore servicing method of one of the eighteenth through the twenty-second embodiments, wherein repositioning the wellbore servicing system comprises repositioning at least a portion of the wellbore servicing system within the wellbore.

A twenty-fourth embodiment, which is the wellbore servicing method of one of the eighteenth through the twenty-third embodiments, wherein repositioning the wellbore servicing system comprises removing the wellbore servicing system from the wellbore.

A twenty-fifth embodiment, which is an actuatable valve tool comprising:

a housing defining the axial flowbore, a flapper valve, wherein, when the flapper valve is in an activated state, the flapper valve is free to move between a closed position in which the flapper valve blocks the axial flowbore and an open position in which the flapper valve does not block the axial flowbore, and wherein, when the flapper valve is in an inactivated state, the flapper valve is retained in the open position, a sliding sleeve;

wherein, in a first position, the sliding sleeve does not interact with the flapper valve, and wherein, in a second position and a third position, the sliding sleeve retains the flapper valve in the open position; and a transition system configured to control the longitudinal movement of the sliding sleeve, wherein the transition system comprises:

a j-slot; and a lug, wherein the lug is disposed within a least a portion of the j-slot.

A twenty-sixth embodiment, which is the actuatable valve tool of the twenty-fifth embodiment, wherein the transition system is configured to guide the sliding sleeve from the first position to the second position, from the second position to the third position, from the third position back to the second position, and from the second position back to the first position.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A wellbore servicing system comprising:

a work string comprising a coiled tubing string and a jointed tubing segment; and an actuatable valve tool defining an axial flowbore and incorporated within the work string between the coiled tubing string and the jointed tubing segment, wherein the actuable valve tool comprises:

a housing defining the axial flowbore; and a sliding sleeve, wherein the sliding sleeve is movably positioned within the housing via at least two seals such that there is a differential between the surfaces of the sliding sleeve exposed to the axial flowbore facing a first direction and the surfaces of the sliding sleeve exposed to the axial flowbore facing a second direction, wherein the actuatable valve tool is transitionable from a first mode to a second mode, from the second mode to a third mode, and from the third mode to a fourth mode, wherein the actuatable valve tool is configured to transition from the first mode to the second mode upon an application of pressure to the axial flowbore of at least a threshold pressure, wherein the actuatable valve tool is configured to transition from the second mode to the third mode upon a dissipation of pressure from the axial flowbore to not more than the threshold pressure, wherein, in the first mode, the actuatable valve tool is configured to allow fluid communication via the axial flowbore in the first direction and to disallow fluid communication via the axial flowbore in the second direction, and wherein, in the second, and third modes, the actuatable valve tool is configured to allow fluid communication via the axial flowbore in both the first direction and the second direction.

2. The wellbore servicing system of claim 1, wherein the actuatable valve tool is transitionable from the fourth mode to the first mode.

3. The wellbore servicing system of claim 2, wherein the actuatable valve tool is configured to transition from the third mode to the fourth mode upon an application of pressure to the axial flowbore of at least the threshold pressure, and wherein the actuatable valve tool is configured to transition from the fourth mode to the first mode upon a dissipation of pressure from the axial flowbore to not more than the threshold pressure.

4. The wellbore servicing system of claim 1, wherein the actuatable valve tool further comprises;

a flapper valve, wherein, when the flapper valve is in an activated state, the flapper valve is free to move between a closed position in which the flapper valve blocks the axial flowbore and an open position in which the flapper valve does not block the axial flowbore, and wherein, when the flapper valve is in an inactivated state, the flapper valve is retained in the open position.

5. The wellbore servicing system of claim 4, wherein the sliding sleeve is movable from a first longitudinal position to a second longitudinal position, from the second longitudinal position to a third longitudinal position.

6. The wellbore servicing system of claim 5, wherein, in the first longitudinal position, the sliding sleeve does not interact with the flapper valve, and wherein, in the second and third longitudinal positions, the sliding sleeve retains the flapper valve in the open position.

7. The wellbore servicing system of claim 5, further comprising a transition system configured to control the longitudinal movement of the sliding sleeve.

8. The wellbore servicing system of claim 7, wherein the transition system comprises:

a j-slot; and a lug, wherein the lug is disposed within at least a portion of the j-slot.

9. The wellbore servicing system of claim 5, further comprising a biasing member, wherein the biasing member is configured to bias the sliding sleeve in the second direction.

10. The wellbore servicing system of claim 1, wherein the wellbore servicing system further comprises a wellbore servicing tool incorporated within the work string at a location downhole from the actuatable valve tool.

11. The wellbore servicing system of claim 1, wherein the sliding sleeve is movably positioned within the housing such that the area of the surfaces of the sliding sleeve exposed to the axial flowbore facing the first direction is less than the surfaces of the sliding sleeve exposed to the axial flowbore facing the second direction.

12. A wellbore servicing method comprising:

disposing a wellbore servicing system comprising a work string and an actuatable valve tool within a wellbore, the work string comprising a coiled tubing string and a jointed tubing segment, the actuatable valve tool incorporated within the work string between the coiled tubing string and the jointed tubing segment and generally defining an axial flowbore, wherein the actuatable valve tool comprises:

a housing defining the axial flowbore; and a sliding sleeve, wherein the sliding sleeve is movably positioned within the housing via at least two seals such that there is a differential between the surfaces of the sliding sleeve exposed to the axial flowbore facing a first direction and the surfaces of the sliding sleeve exposed to the axial flowbore facing a second direction, wherein the actuable value tool is configured in a first mode when the wellbore servicing system is disposed within the wellbore, wherein in the first mode, the actuable valve tool allows downward fluid communication via the axial flowbore and disallows upward fluid communication via the axial flowbore;

making a first application of fluid pressure of at least a pressure threshold to the axial flowbore, wherein the first application of fluid pressure transitions the actuatable valve tool to a second mode in which the actuatable valve tool allows both upward and downward fluid communication;

allowing a first dissipation of fluid pressure applied to the axial flowbore to less than the pressure threshold, wherein allowing the first dissipation of fluid pressure transitions the actuatable valve tool to a third mode in which the actuatable valve tool allows both upward and downward fluid communication;

making a second application of fluid pressure of at least the pressure threshold to the axial flowbore, wherein the second application of fluid pressure transitions the actuatable valve tool to a fourth mode in which the actuatable valve tool allows both upward and downward fluid communication; and allowing a second dissipation of fluid pressure applied to the axial flowbore to less than the pressure threshold, wherein allowing the fluid pressure applied to the axial flowbore to dissipate transitions the actuatable valve tool to the first mode.

13. The wellbore servicing method of claim 12, wherein making the first application of fluid pressure comprises downwardly communicating a fluid via the axial flowbore.

14. The wellbore servicing method of claim 12, wherein allowing the first dissipation of fluid pressure comprises upwardly communicating a fluid via the axial flowbore.

15. The wellbore servicing method of claim 12, wherein making the second application of fluid pressure comprises downwardly communicating a fluid via the axial flowbore.

16. The wellbore servicing method of claim 12, wherein allowing the second dissipation of fluid pressure comprises upwardly communicating a fluid via the axial flowbore.

17. A wellbore servicing method comprising:

disposing a wellbore servicing system within a wellbore, the wellbore servicing system comprising a work string and an actuatable valve tool, the work string comprising a coiled tubing string and a jointed tubing segment, the actuatable valve tool incorporated within the work string between the coiled tubing string and the jointed tubing segment and generally defining an axial flowbore, wherein the actuable valve tool comprises:

a housing defining the axial flowbore; and a sliding sleeve, wherein the sliding sleeve is movable positioned within the housing via at least two seals such that there is a differential between the surfaces of the sliding sleeve exposed to the axial flowbore facing a first direction and the surfaces of the sliding sleeve exposed to the axial flowbore facing a second direction, wherein during disposing the wellbore servicing system within the wellbore, the actuatable valve tool is configured so as to allow downward fluid communication via the axial flowbore and to disallow upward fluid communication via the axial flowbore;

reconfiguring the actuatable valve tool so as to allow downward and upward fluid communication via the axial flowbore, wherein reconfiguring the actuatable valve tool comprises applying a fluid pressure of at least a pressure threshold to the axial flowbore and allowing a fluid pressure applied to the axial flowbore to dissipate to less than the pressure threshold;

reconfiguring the actuatable valve tool so as to allow downward fluid communication via the axial flowbore and to disallow upward fluid communication via the axial flowbore, wherein reconfiguring the actuatable valve tool comprises applying a fluid pressure of at least a pressure threshold to the axial flowbore, allowing a fluid pressure applied to the axial flowbore to dissipate to less than the pressure threshold; and repositioning the wellbore servicing system.

18. The wellbore servicing method of claim 17, wherein reconfiguring the actuatable valve tool so as to allow downward and upward fluid communication via the axial flowbore comprises communicating a fluid downwardly via the axial flowbore.

19. The wellbore servicing method of claim 18, wherein the fluid is communicated into a subterranean formation zone at a rate sufficient to initiate a perforation, at a pressure sufficient to initiate a perforation, at a rate sufficient to extend a perforation, at a pressure sufficient to extend a perforation, at a rate sufficient to initiate a fracture, at a pressure sufficient to initiate a fracture, at a rate sufficient to extend a fracture, at a pressure sufficient to extend a fracture, or combinations thereof.

20. The wellbore servicing method of claim 18, wherein the fluid is a perforating fluid, a hydrajetting fluid, a fracturing fluid, an acidizing fluid, or combinations thereof.

21. The wellbore servicing method of claim 17, further comprising communicating a fluid upwardly through the axial flowbore.

22. The wellbore servicing method of claim 17, wherein repositioning the wellbore servicing system comprises repositioning at least a portion of the wellbore servicing system within the wellbore.

23. The wellbore servicing method of claim 17, wherein repositioning the wellbore servicing system comprises removing the wellbore servicing system from the wellbore.

24. A wellbore servicing system comprising:

a work string comprising a coiled tubing string and a jointed tubing segment; and an actuatable valve tool incorporated within the work string between the coiled tubing string and the jointed tubing segment comprising:

a housing defining the axial flowbore, a flapper valve, wherein, when the flapper valve is in an activated state, the flapper valve is free to move between a closed position in which the flapper valve blocks the axial flowbore and an open position in which the flapper valve does not block the axial flowbore, and wherein, when the flapper valve is in an inactivated state, the flapper valve is retained in the open position, a sliding sleeve;

wherein the sliding sleeve is movable positioned within the housing via at least two seals such that there is a differential between the surfaces of the sliding sleeve exposed to the axial flowbore facing a first direction and the surfaces of the sliding sleeve exposed to the axial flowbore facing a second direction, wherein, in a first position, the sliding sleeve does not interact with the flapper valve, and wherein, in a second position and a third position, the sliding sleeve retains the flapper valve in the open position; and a transition system configured to guide the sliding sleeve from the first position to the second position upon application of pressure to the axial flowbore of at least a threshold pressure, to guide the sliding sleeve from the second position to the third position upon a dissipation of pressure from the axial flowbore to not more than the threshold pressure, and to guide the sliding sleeve from the third position back to the second position upon application of pressure to the axial flowbore of at least a threshold pressure, and to guide the sleeve from the second position back to the first position upon a dissipation of pressure from the axial flowbore to not more than the threshold pressure, wherein the transition system comprises:

a j-slot; and a lug, wherein the lug is disposed within a least a portion of the j-slot.

25. The wellbore servicing system of claim 24, wherein the wellbore servicing system further comprises a wellbore servicing tool incorporated within the work string at a location downhole from the actuatable valve tool.

26. The wellbore servicing system of claim 24, further comprising a biasing member, wherein the biasing member is configured to bias the sliding sleeve away from the second position.

* * * * *